US005591705A

United States Patent [19]

Brinson et al.

[11] Patent Number: 5,591,705

[45] Date of Patent: Jan. 7, 1997

[54] RINSE-ACTIVE FOAM CONTROL PARTICLES

[75] Inventors: Alan D. Brinson, Tervuren; David X. Cumming, Brussels, both of Belgium; David W. York, Newcastle Upon Tyne, Great Britain

[73] Assignee: The Procter & Gamble Company, Cincinnati, Ohio

[21] Appl. No.: 244,444

[22] PCT Filed: Dec. 1, 1992

[86] PCT No.: PCT/US92/10390

§ 371 Date: Sep. 30, 1994

§ 102(e) Date: Sep. 30, 1994

[87] PCT Pub. No.: WO93/11216

PCT Pub. Date: Oct. 6, 1993

[30] Foreign Application Priority Data

Dec. 3, 1991 [EP] European Pat. Off. ..... 91203149

[51] Int. Cl.[6] ..... C11D 9/00

[52] U.S. Cl. ..... 510/276; 510/353; 510/445; 510/460; 510/466; 510/488; 510/491; 510/511

[58] Field of Search ..... 252/108, DIG. 1, 252/321, 358, 174.14, 174.15; 510/353, 276, 445, 460, 466, 488, 491, 511

[56] References Cited

U.S. PATENT DOCUMENTS

| | | | |
|---|---|---|---|
| 4,009,114 | 2/1977 | Yurko | 252/174.19 |
| 4,192,761 | 3/1980 | Peltre et al. | 252/99 |
| 4,321,165 | 3/1982 | Smith et al. | 252/528 |
| 4,338,204 | 7/1982 | Spadini et al. | 252/8.75 |
| 4,347,168 | 8/1982 | Murphy et al. | 252/547 |
| 4,391,726 | 7/1983 | Koster | 252/527 |
| 4,430,243 | 2/1984 | Bragg | 252/91 |
| 4,687,592 | 8/1987 | Collins et al. | 252/99 |
| 4,806,266 | 2/1989 | Burrill | 252/174.13 |
| 4,824,593 | 4/1989 | Appel et al. | 252/174.13 |
| 4,966,606 | 10/1990 | Garner-Gray et al. | 252/174.14 |
| 5,238,596 | 8/1993 | Smith | 252/174.15 |

FOREIGN PATENT DOCUMENTS

| | | | |
|---|---|---|---|
| 1489395 | 7/1976 | France . | |
| 1189114 | 4/1970 | United Kingdom | C11D 1/68 |
| 1204123 | 9/1970 | United Kingdom | C11D 3/02 |

*Primary Examiner*—Glenn A. Caldarola
*Assistant Examiner*—Patricia L. Hailey
*Attorney, Agent, or Firm*—Ken K. Patel; Jacobus C. Rasser; Jerry J. Yetter

[57] ABSTRACT

The present invention provides rinse-active foam-control particles for inclusion in a detergent composition in powder form, consisting essentially of a soap of fatty acids of which at least 80% contain from 16 to 18 carbon atoms, the geometric mean particle size of the particles being inferior to 1 mm, preferably inferior to 0.4 mm.

The present invention also encompasses a process for making said foam-control agents, as well as high sud and low sud executions of detergent compositions containing said foam-control particles.

10 Claims, No Drawings

RINSE-ACTIVE FOAM CONTROL PARTICLES

TECHNICAL FIELD

The present invention is concerned with rinse-active foam control particles for inclusion in a detergent composition, i.e. foam control particles mainly active in the rinse-cycle of a laundry process, with a method for making such particles, and with detergent compositions containing such particles.

BACKGROUND

It has become common practice in the detergent industry to include in detergent compositions materials which are intended to control the amount of foam produced during a laundry process.

Although suds-control during the washing cycle of a laundry process is important, so as to avoid negative interference with the action of the wash liquor upon the fabrics, it is also known that suds-control during the rinse cycle of a laundry process is desirable;

Indeed, excessive foaming during the rinse cycle in a washing machine can cause foam spillage and damage to the machine, while in a handwash context, there is an advantage in lowering the foam production during rinsing, so as to shorten this step.

Soaps of fatty acids have been used for such a rinse-active suds control function, and they have always been spray dried together with the rest of the detergent composition;

However, there is a desire to reduce organic emissions during manufacturing of detergents, in particular during spray-drying.

The present invention provides foam control fatty acid soap particles which are made separately from the rest of the spray-dried detergent composition, and a process to make them, not causing organic emissions.

SUMMARY OF THE INVENTION

The present invention provides rinse-active foam-control particles for inclusion in a detergent composition in powder form, consisting essentially of a soap of fatty acids of which at least 80% contain from 16 to 18 carbon atoms, the geometric mean particle size of the particles being inferior to 1 mm, preferably inferior to 0.4 mm.

The present invention also encompasses a process for making said foam-control agents, as well as high suds and low sud executions of detergent compositions containing said foam-control particles.

DETAILED DESCRIPTION OF THE INVENTION

The Antifoam Particles

The foam-control particles of the invention are mainly constituted of a soap of fatty acids of which at least 80% by weight contain from 16 to 18 carbon atoms; preferred fatty acids are tallow or tallow/coconut mixtures at a weight ratio of tallow to coconut not less than 70/30; particularly preferred is a 90/10 tallow/coconut mixture. Suitable cations which render the soap water soluble and/or dispersible include sodium, potassium, ammonium, monoethanolammonium, diethanolammonium, triethanolammonium, tetramethylammonium, etc. Sodium ions are preferred.

The particles of the invention are further characterized by their particle size, which is such that the geometric mean particle size, which is the median of the cumulative weight distribution, should be less than 1 mm and preferably less than 0.4 mm.

The individual particle size of a particle is meant as being the sum of the longest and the shortest dimension of the particle divided by two.

The cumulative weight distribution of the particles can be conveniently measured by sieving with an air-fluidized sieve.

Optional Ingredients

The particles herein optionally include a free-flowing agent such as amorphous silica, at levels not exceeding 5% by weight of the particle.

Making process for the anti-foam particles of the invention

The process herein contains essentially the steps of drying a fatty acid soap slurry to a low moisture level, i.e. a moisture level not exceeding 9%, preferably not exceeding 5% by weight of the slurry, then pressing the slurry into noodles, and successively grinding the noodles to a fine powder with the particle size required herein.

The control of the moisture level is a particularly critical feature of the process herein, since successful grinding to the required particle size will not be possible without meeting the claimed moisture level.

Drying of the soap slurry is preferably achieved under vacuum. Supplementary drying during the grinding process may be appropriate, and achieved for example in an air classifier.

A typical method to measure the moisture level in the sopa slurry and/or the noodles is a solvent distillation method, using a Bidwell® apparatus.

Detergent Composition

In another embodiment of the present invention, it is herewith provided a detergent composition in powder form, comprising a surface-active agent and foam control particles such as described above. Addition of the particles herein in detergent compositions can be achieved by e.g. dry-mixing. The amount of foam control particles is typically from 0.25 to 5% by weight of the composition, depending on the type of detergent composition involved.

SURFACTANT

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium. One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula $R^2$ $$-\underset{\underset{O}{\|}}{C}-\underset{\underset{R^1}{|}}{N}-Z,$$

wherein $R^1$ is H, $C_{1-4}$ hydrocarbyl, 2-hydroxy ethyl, 2-hydroxy propyl or a mixture thereof, $R_2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R_1$ is methyl, $R_2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

A further class of surfactants are the semi-polar surfactants such as amine oxides. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are substituted by methyl, hydroxyethyl or hydroxypropyl groups.

Another class of surfactants are amphoteric surfactants, such as polyamine-based species.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

Mixtures of surfactant types are preferred, more especially anionic-nonionic and also anionic-nonionic-cationic mixtures. Particularly preferred mixtures are described in British Patent No. 2040987 and European Published Application No. 0 087 914. The detergent compositions can comprise from 1%–70% by weight of surfactant, but usually the surfactant is present in the compositions herein an amount of from 1% to 30%, more preferably from 10–25% by weight.

The detergent compositions herein preferably also contain a builder, which can be selected from phosphates, aluminosilicate ion exchangers (zeolites), and water-soluble monomeric or oligomeric carboxylate chelating agents such as citrates, succinates, oxydisuccinates, as well as mixtures of the above species.

Other suitable builder materials include alkali metal carbonates, bicarbonates and silicates, organic phosphonates, amino polyalkylene phosphonates and amino polycarboxylates, ethylene diamine tetraacetic acid and nitrilotriacetic acid. Other suitable water-soluble organic salts are the homo- or co-polymeric polycarboxylic acids or their salts in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Other ingredients which typically form part of a detergent composition in powder form include filler salts such as sodium sulphates, bleaching agents, such as sodium perborate and percarbonate, bleach activators, anti redeposition agents such as carboxymethyl cellulase, enzymes, such as proteases, amylases, lipases, and cellulases, brighteners, fabric softening clays, perfumes, dyes, pigments.

The detergent compositions herein can be of the "high-suds" type, and be designed for hand-wash or in upright washing machine utilization. In such executions, the level of foam control particles is typically from 2% to 5% by weight.

The compositions of the invention can also be of the "low-suds" type and thus be adapted for use in washing machines of all types; in this latter category, detergent compositions encompass "compact" executions, where the density is typically above 550 g/liter of composition, and the level of filler salt is typically below 5% by weight of the composition.

In such executions, the level of foam-control particles is typically from 0.25% to 2%.

In the "low-suds" execution herein, a suds-controlling agent active in the wash cycle is typically included, in addition to the rinse-active foam-control agents of the invention. Such additional foam-control agents are preferably silicones.

EXAMPLES

The following examples illustrate the invention and facilitate its understanding.

The abbreviations for the individual ingredients have the following meaning:

LAS: sodium salt of linear dodecyl benzene sulfonate

TAS: sodium salt of tallow alcohol sulfate

Nonionic: fatty alcohol (C14–C15) ethoxylated with about 7 moles of ethylene oxide Copolymer AA/MA: copolymer of acrylic acid and maleic acid CMC: carboxymethylcellulose Na Phosphonate: sodium salt of ethylenediamine tetramethylene phosphonic acid TAED: tetra acetyl ethylene diamine The following compositions were prepared.

Example I

"High Suds" Execution

| | |
|---|---|
| LAS | 20% |
| Sodium Tripolyphosphate | 23% |
| Sodium Silicate | 6% |
| CMC | 0.15% |
| Sodium Sulphate | 34% |
| Na Phosphonate | 0.1% |
| Sodium Carbonate | 5% |
| Copolymer AA/MA | 2.5% |
| Sodium Soap *particles* | 3% |
| Enzyme, brighteners, perfume and minors | up to 100 |
| Density | 360 g/l |

*prepared as described above and dry-mixed with the rest of the composition.

Example II

"Low Suds" Execution, in Compact Form

| | |
|---|---|
| LAS | 8% |
| TAS | 2% |
| Nonionic | 6% |
| Sodium Carbonate | 14% |
| Sodiuym Citrate | 6% |
| Zeolite | 20% |
| Sodium Silicate | 3% |
| CMC | 0.5% |
| Sodium Sulphate | 3.5% |
| Na Phosphonate | 0.4% |
| Sodium Na Perborate Monohydrate | 16% |
| Sodium Soap *particles* | 1% |
| Silicone | 0.5% |
| Sodium Salt of Copolymer AA/MA | 4% |
| TAED | 5% |
| Enzyme, perfume, brighteners and minors | up to 100 |
| Density | 700 g/l |

*prepared as described above and dry-mixed with the rest of the composition.

We claim:

1. A particulate foam-control composition for inclusion in a detergent composition in powder form, consisting essentially of a soap of fatty acids selected from the group consisting of tallow soap, and tallow/coconut soap with a weight ratio of tallow to coconut not less than 70/30, of which at least 80 % contain from 16 to 18 carbon atoms, the geometric mean particle size of the particles being inferior to 1 mm, wherein said particulate foam-control composition becomes active primarily in the rinse cycle of a washing operation.

2. A particulate foam-control composition according to claim 1 having a geometric mean particle size inferior to 0.4 mm.

3. A process for making a foam-control agent according to claim 1, comprising the steps of: drying a fatty acid soap slurry to a moisture level inferior to 9% by weight of the slurry, pressing said slurry into noodles, and grinding said noodles to a fine powder.

4. A process according to claim 3 wherein the soap slurry is dried to a moisture level not exceeding 5% by weight of the slurry.

5. A process according to claim 3 wherein the soap slurry is vacuum dried.

6. A high-suds detergent composition in powder form comprising a surface-active agent, and from 2 to 5% by weight foam-control particles according to claim 1.

7. A detergent composition according to claim 6 which also contains a builder selected from the group of phosphates, phosphonates, aluminosilicate ion exchangers, citrates, carbonates, silicates, and mixtures thereof.

8. A low suds detergent composition in powder form comprising a surface-active agent, and from 0.25 to 2% by weight foam-control particles according to claim 1.

9. A detergent composition according to claim 8 which also contains a silicone foam-control agent active in the wash cycle.

10. A detergent composition according to claim 8 which also contains a builder selected from the group consisting of phosphates, phosphonates, aluminosilicate ion exchangers, citrates, carbonates, silicates and mixtures thereof.

* * * * *